US007900978B2

(12) United States Patent
Zimmer

(10) Patent No.: US 7,900,978 B2
(45) Date of Patent: Mar. 8, 2011

(54) RETURN SPRING ASSEMBLY FOR A LOCK MECHANISM

(75) Inventor: Todd C Zimmer, Meriden, CT (US)

(73) Assignee: Sargent Manufacturing Company, New Haven, CT (US)

( * ) Notice: Subject to any disclaimer, the term of this patent is extended or adjusted under 35 U.S.C. 154(b) by 161 days.

(21) Appl. No.: 11/346,782

(22) Filed: Feb. 2, 2006

(65) Prior Publication Data

US 2007/0176435 A1 Aug. 2, 2007

(51) Int. Cl.
*E05C 19/10* (2006.01)

(52) U.S. Cl. ..... 292/100; 292/347; 292/336.3

(58) Field of Classification Search ..... 292/100, 292/347, 336.3, 356, 357, 224; 16/82
See application file for complete search history.

(56) References Cited

U.S. PATENT DOCUMENTS

| | | | | | |
|---|---|---|---|---|---|
| 831,386 | A * | 9/1906 | Simmons | 70/152 |
| 480,364 | A | 2/1938 | Ramsell | |
| 2,119,866 | A | 6/1938 | Milligan | |
| 2,729,485 | A | 1/1956 | Schlage | |
| 2,801,869 | A | 8/1957 | George | |
| 3,207,541 | A * | 9/1965 | Bartlett | 292/220 |
| 3,212,806 | A * | 10/1965 | Russell et al. | 292/336.3 |
| 4,869,083 | A | 9/1989 | DeMarseilles et al. | |
| 4,911,489 | A | 3/1990 | Hansen et al. | |
| 4,998,760 | A * | 3/1991 | Nixon et al. | 292/347 |
| 5,265,924 | A | 11/1993 | Kim | |
| 5,718,468 | A * | 2/1998 | Qureshi et al. | 292/347 |
| 5,727,406 | A * | 3/1998 | Banducci | 70/224 |
| 5,794,472 | A * | 8/1998 | Kester et al. | 70/472 |
| 6,101,856 | A * | 8/2000 | Pelletier et al. | 70/472 |
| 6,540,274 | B2 * | 4/2003 | Bates et al. | 292/336.5 |
| 6,626,018 | B2 | 9/2003 | Eller et al. | |
| 6,869,116 | B2 | 3/2005 | Dalsing | |
| 6,880,872 | B2 * | 4/2005 | Eller et al. | 292/357 |
| 2005/0023846 | A1 * | 2/2005 | Eller et al. | 292/357 |
| 2007/0176435 | A1 * | 8/2007 | Zimmer | 292/336.3 |

* cited by examiner

*Primary Examiner* — Carlos Lugo
*Assistant Examiner* — Kristina R Fulton
(74) *Attorney, Agent, or Firm* — DeLio & Peterson, LLC

(57) ABSTRACT

A return spring assembly for returning a handle to the horizontal orientation includes a spring housing having an outer flange that contacts an outer surface of a door around the perimeter of a bored opening and an inner portion with a curved section that securely supports a latchbolt lock mechanism when an identical return spring assembly is installed on an opposite side of the door. A spring is driven by two spring drivers operating with a lost motion connection to the handle spindle to alternately compress the spring from opposite directions as the handle is rotated in opposite directions. The spring is positioned to not interfere with a linkage extending out from the latchbolt lock mechanism.

20 Claims, 5 Drawing Sheets

RETURN SPRING ASSEMBLY FOR A LOCK MECHANISM

BACKGROUND OF THE INVNETION

1. Field of the Invention

The present invention relates to spring mechanisms used with lock mechanisms to return a handle to an original position after the handle has been rotated to open a door. The invention is particularly directed to spring mechanisms to be used with lever handles and lock mechanisms having lock function controls extending outward from a latchbolt mechanism to return the lever handle to a horizontal position.

2. Description of Related Art

Lock mechanisms are driven by inner and outer handles mounted on corresponding spindles that extend from the handles on opposite sides of the door to a lock mechanism located within a bored opening in the door. A latchbolt portion of the lock mechanism is located within a smaller bored opening that extends inward from the edge of the door and perpendicularly intersects the larger bored opening, which extends between the opposite faces of the door.

After one of the handles is turned to open the door, it must be returned to its initial position and this return function is typically accomplished with one or more springs. The return springs may be integrated into the lock or they may be located in a separate housing mounted inside the bored opening and/or on the surface of the door at the base of the handle.

When round doorknobs are installed, relatively little force is required to return the doorknob to its initial position, however, it has become more common to install lever handles. Although lever handles are easier to operate, they require the return spring assembly to produce significantly more torque to lift the offset portion of the lever handle against the force of gravity and return it to the initial horizontal orientation. As a consequence, it has become necessary to use larger and more powerful return springs than were previously necessary for round doorknobs.

Larger springs generally require more space than can easily be found inside the lock mechanism, so separate return spring mechanisms are widely used—one located on each side of the door. When the return spring mechanism is mounted on the outer surface of the door, however, it produces a relatively thick and bulky appearance, which is unsightly. A thinner appearance is preferred, and this requires that the springs be located at least partially inside the bored opening of the door. However, positioning the return spring assembly inside the bored opening in the door limits the space available for the lock mechanism, which must also be located within the bored opening.

Conventional designs that position the return spring assembly inside the bored opening use one or more springs that extend around substantially the entire inner perimeter of the bored opening on each side of the door. This provides the maximum space for the spring and allows it to maximize the torque produced. The spring force on each side of the door may come from one large compression spring, or from a pair of compression springs arranged end to end, or from a coiled torsion spring. In each case, however, the spring extends around a substantial portion of the inside perimeter of the bored opening.

This use of the inner perimeter of the bored opening is acceptable for many door lock mechanisms where the locking mechanism is in a central lock core. In these designs the interaction between the user and the locking mechanism comes from a button or key on the handle that connects to the locking mechanism through linkages or mechanisms that are located close to or directly on the axis of the bored opening in the door. By placing the lock control linkages close to this axis, the linkages are positioned well inside the perimeter space required for the locking springs and there is no interference between the springs and the lock mechanism linkages.

However, in other lock mechanism designs, of the type for which this invention is particularly suitable, the locking mechanism is more closely integrated with the latchbolt portion. In these designs, the lock control linkages extend directly outward from the latchbolt mechanism at the front of the lock mechanism bored opening and the lock linkages are far from the axis of rotation of the handles. As a result, the lock control linkages in such designs will interfere with the springs in a conventional spring return mechanism where the springs occupy the entire inner circumference of the bored opening.

Bearing in mind the problems and deficiencies of the prior art, it is therefore an object of the present invention to provide a return spring assembly that is compatible with lock mechanisms having a control linkage extending outward from the latchbolt mechanism.

It is another object of the present invention to provide a return spring assembly that does not extend into the space at the front of a bored opening in a door and has the spring mechanism located at least partially inside the bored opening to provide a reduced visual thickness as compared to return spring assemblies that are mounted outside the bored opening on the surface of the door.

It is another object of the present invention to provide a return spring assembly that provides additional support to the latchbolt mechanism of a lock mechanism.

Still other objects and advantages of the invention will in part be obvious and will in part be apparent from the specification.

SUMMARY OF THE INVENTION

The above and other objects, which will be apparent to those skilled in this art, are achieved in the present invention which is directed to a return spring assembly for a lock mechanism adapted for installation in a bored opening in a door. The return spring assembly includes a spring housing having an outer flange and an inner portion having a curved section. The outer flange has a diameter greater than the bored opening and makes supporting contact with an outer surface of the door when the return spring assembly is inserted into the bored opening.

The inner portion extends at least partially into the bored opening in the door when the outer flange is in contact with the face of the door to provide a thinner appearance. The curved section extends less than one hundred eighty degrees around the perimeter of the inner portion and more deeply into the bored opening than the remainder of the inner portion, preferably at least half the thickness of the door.

An annular spring channel is formed in the spring housing and holds a compression spring that acts to return the handle to the horizontal orientation. Two spring drivers, preferably identical, compress the spring from opposite directions. The first spring driver has a first arm engaging a first end of the spring and the second spring driver has a second arm engaging a second end of the spring. Each spring driver includes a center opening shaped to engage a spindle driven by a handle.

The first spring driver moves as the handle is rotated in a first direction to compress the spring from the first end of the spring and the second spring driver moves as the handle is rotated in an opposite direction to compress the spring from the second end of the spring. The spring drivers are driven with lost motion, the first spring driver remaining stationary as the second spring driver moves to compress the spring from the second end and the second spring driver remaining stationary as the first spring driver moves to compress the spring from the first end.

In one aspect of the invention, the center of each spring driver includes an opening defined by a partial rotation of the cross-sectional shape of the spindle, which is typically square. This produces a cross-shaped opening and the opening provides a lost motion engagement between the spring driver and the spindle.

In another aspect of the invention, the curved section of the spring housing extends into the bored opening in the door into supporting contact with the lock mechanism. This provides a rugged connection between the lock and the door and the return spring assembly. Preferably, the curved section of the spring housing extends into the bored opening in the door into supporting contact with an upper side of the lock mechanism. A second return spring assembly having a second spring housing and a second curved section is typically inserted from the opposite side of the door and the two curved sections contact opposite, upper and lower, surfaces of the lock mechanism to trap it and secure it therebetween.

In still another aspect of the invention, the spring housing includes four bosses that act as stops for the spring driver arms at opposite ends of their travel. The arm of the first spring driver contacts a first one of the bosses when the first spring driver is not being driven; the arm of the second spring driver contacts a second one of the bosses when the second spring driver is not being driven; the arm of the first spring driver contacts a third one of the bosses when the first spring driver is driven to maximally compress the spring; and the arm of the second spring driver contacts a fourth one of the bosses when the second spring driver is driven to maximally compress the spring in the opposite direction from the first spring driver.

In the most highly preferred embodiment of the invention, the arm of the first spring driver contacts the first one of the bosses when the second spring driver is driven to maximally compress the spring and the arm of the second spring driver contacts the second one of the bosses when the first spring driver is driven to maximally compress the spring from the opposite direction. This design shares the loads between the two arms at the limits of travel and strengthens the design significantly.

In still another aspect of the invention, the spring housing includes an opening for receiving a lock linkage extending outward from the lock mechanism. The opening for the lock linkage is located opposite the spring and spring channel, and the spring and spring channel extend only partly around the inner perimeter so that the spring does not interfere with the lock linkage extending through the opening as would occur with a prior art design using springs around the entire inner perimeter.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS(S)

In describing the preferred embodiment of the present invention, reference will be made herein to FIGS. 1-6 of the drawings in which like numerals refer to like features of the invention.

Figure 1:
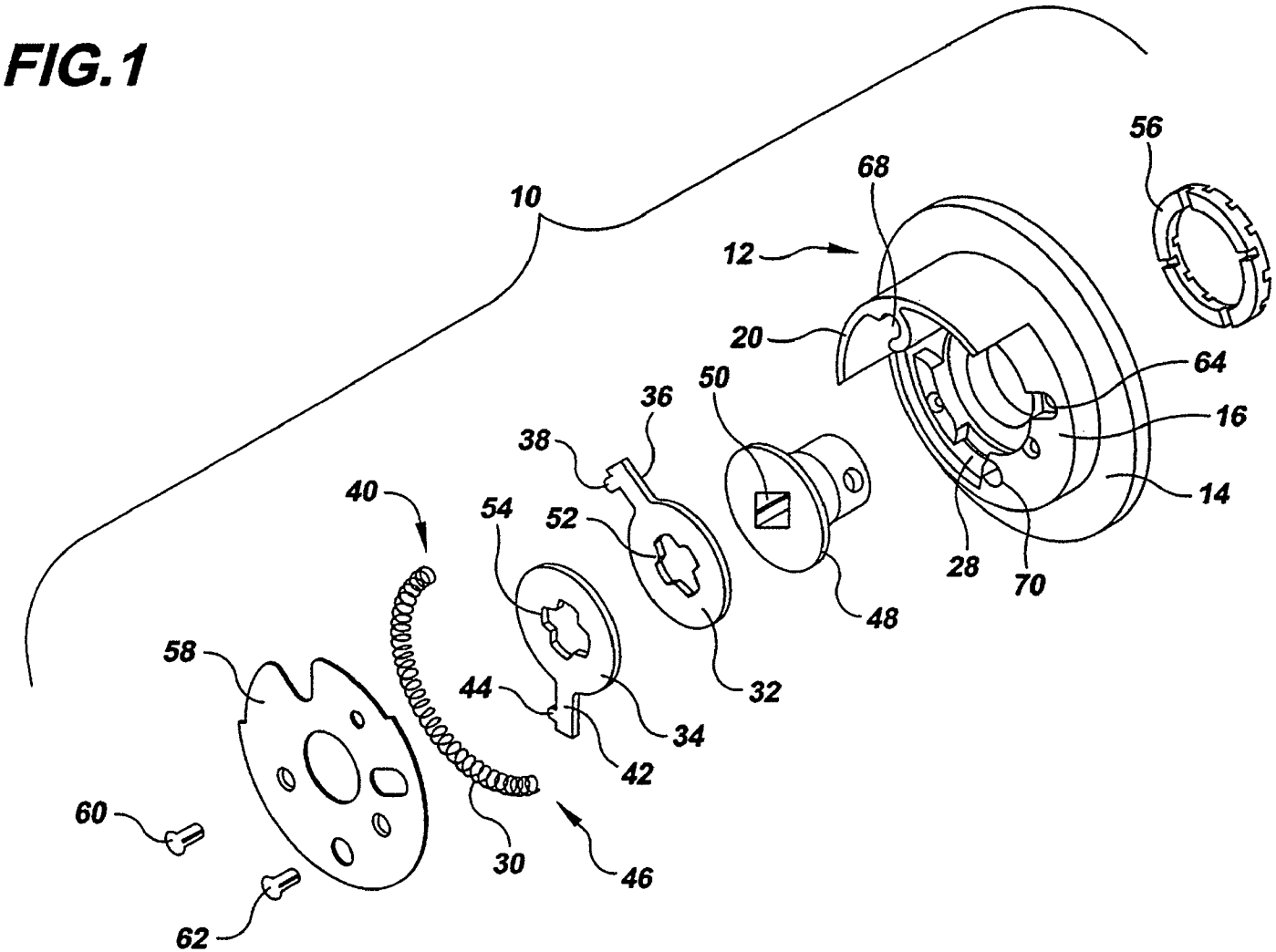
FIG. 1 is an exploded perspective view of a return spring assembly for a lock mechanism according to the present invention.
Figure 6:
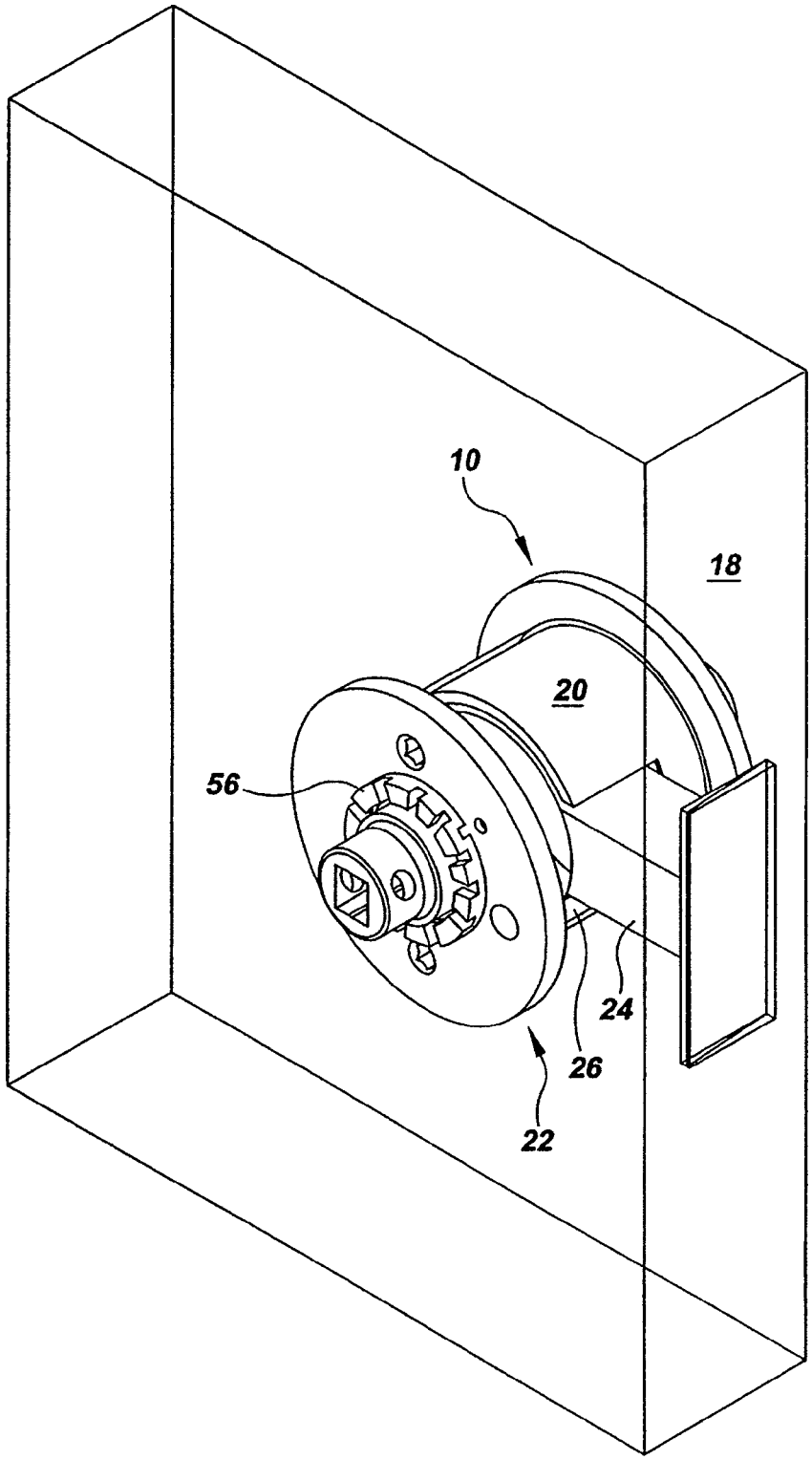
FIG. 6 is a perspective view showing two return spring assemblies according to the present invention, one for each side of the door, installed with a lock mechanism. The lock mechanism is shown generically and is not intended to indicate any particular lock design.

Referring to FIG. 1, the return spring assembly 10 of the present invention includes a spring housing 12 having an outer flange 14 and an inner portion 16. The outer flange 14 has a diameter greater than the diameter of the bored opening in the door into which the spring assembly will be inserted. As can be seen in FIG. 6, the inner portion 16 of the spring housing 12 is inserted into the bored opening of the door 18 until the outer flange 14 makes contact with the face of the door.

The inner portion has a diameter less than the diameter of the bored opening in the door and extends at least partially into the bored opening in the door when the outer flange is in contact with the face of the door. This allows the return spring assembly to provide a thin and attractive appearance when a scalp, rose or escutcheon plate covers it.

Referring again to FIG. 1, the inner portion 16 has a curved section 20 extending less than one hundred eighty degrees around the perimeter of the inner portion. When installed, the curved section 20 extends more deeply into the bored opening in the door 16 than the remainder of the inner portion 16.

As can be seen in FIG. 6, the return spring assembly 10 of FIG. 1 is designed to cooperate with a second identical return spring assembly 22. The first assembly is located on one side of the door 18 with its curved section 20 extending above the latchbolt lock mechanism 24. The second return spring assembly 22 is inserted from the opposite side of the door with its corresponding curved section 26 extending below the latchbolt lock mechanism 24. The two return spring assemblies 10 and 22 are rotated relative to each other so that they trap the latchbolt lock mechanism 24 between their corresponding curved sections 20 and 26.

As can be seen in FIG. 1, the inner portion 16 of the spring housing 12 has an annular spring channel 28 formed in it that receives a compression spring 30. The compression spring 30 is held between a first spring driver 32 and a second spring driver 34. Spring driver 32 includes a first arm 36 having a projection 38 that engages a first end 40 of the spring 30. The second spring driver 34 has a second arm 42 with a second projection 44 that engages the second end 46 of the spring 30.

Hub 48 rotates in the spring housing 12 and has an opening 50 that receives and engages a conventional spindle from a handle. The opening 50 has a shape that matches the square cross section of a conventional spindle, however other shapes may also be used.

The center of the first spring driver 32 includes an opening 52 defined by the partial rotation of the cross-sectional shape of the spindle. The center of the second spring driver 34 also includes an opening 54 defined by the partial rotation of the cross-sectional shape of the spindle. The shape of the openings 52, 54 in the centers of the spring drivers is such that they provide lost motion engagement between the spring driver and the spindle.

Figure 2:
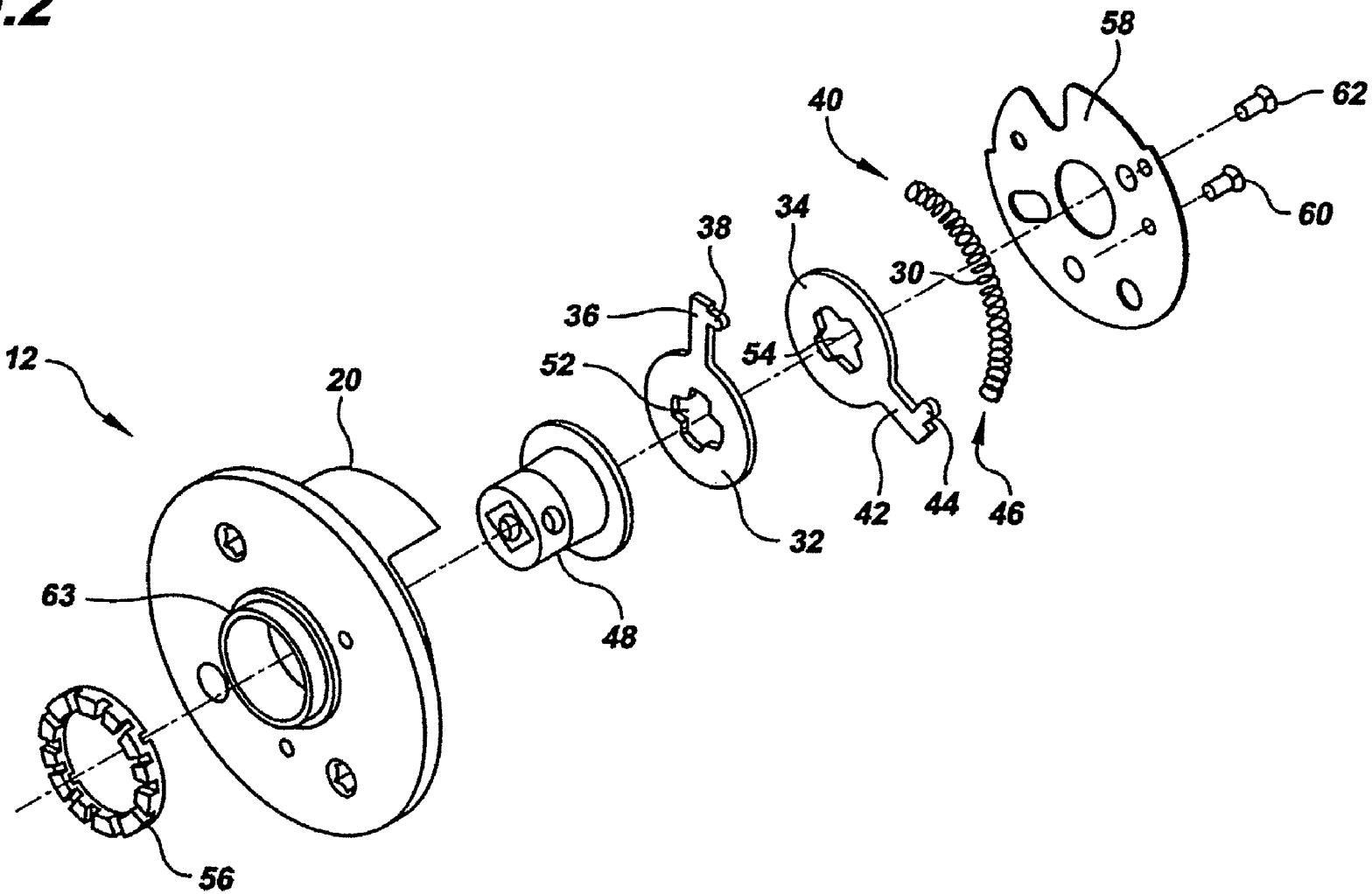
FIG. 2 is also an exploded perspective view of the return spring assembly in FIG. 1 taken from an opposite direction.

The return spring assembly 10 also includes a scalp lock 56 for attaching a scalp, rose or escutcheon, a cover plate 58 and a pair of cover screws 60, 62 that attach the cover plate to the spring housing 12. The cover plate 58 holds the spring 30, the spring drivers 32, 34 and the hub 48 in the housing 12. As can be seen in FIG. 2, the scalp lock 56 attaches to a cylindrical lip 63 on the spring housing 12.

In the preferred design, the scalp lock 56 is made of plastic and radial grooves allow the ring to flex sufficiently to engage the cylindrical lip 63 and/or a scalp, rose or escutcheon attached to the outer surface of the return spring assembly.

Figure 3:
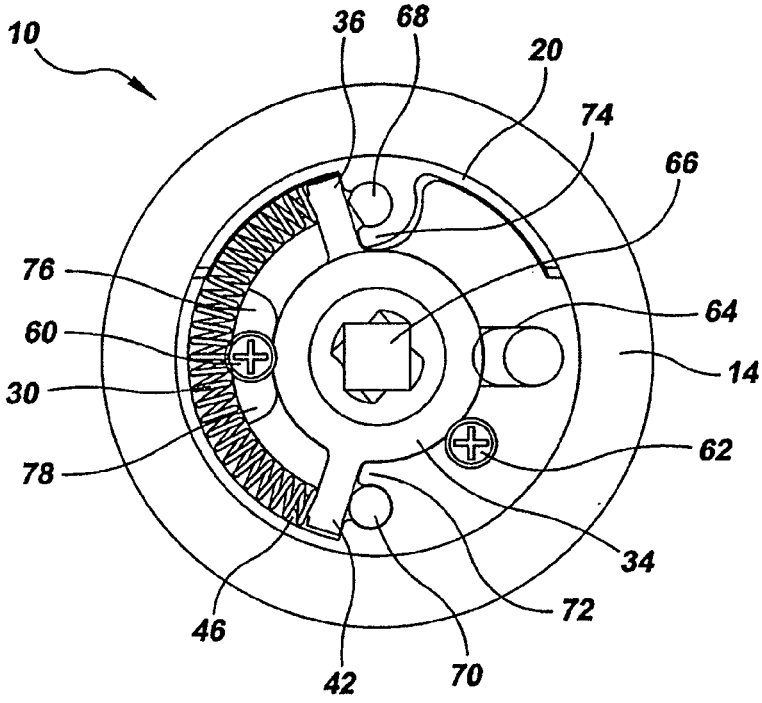
FIG. 3 is a front elevational view of a return spring assembly according to the present invention. The cover plate has been removed to show the relationship of the internal components and the return spring assembly is shown as it would appear with the handle in the non-rotated position.

FIG. 3 shows the assembled return spring assembly 10 with the cover plate 58 removed. The spring 30 is shown uncompressed, in the position it is in when the corresponding handle is horizontal (not rotated). As can be seen here, the spring 30 extends only partially around the inner perimeter of the return spring assembly 10. This arrangement provides clearance at the right side of FIG. 3 for opening 64 and for any desired lock control linkage or button to extend outward from the latchbolt lock mechanism 24 through opening 64 to the surface of the door.

In conventional return spring assembly designs, one or more return springs are located around substantially the entire perimeter of the spring assembly. The design of the present invention, as illustrated in FIG. 3, with a single spring around only part of the perimeter, allows the latchbolt lock mechanism 24 to be controlled through linkages extending through opening 64 located in the space on one side of the spindle that would otherwise be occupied by a return spring in a conventional design.

Figure 4:
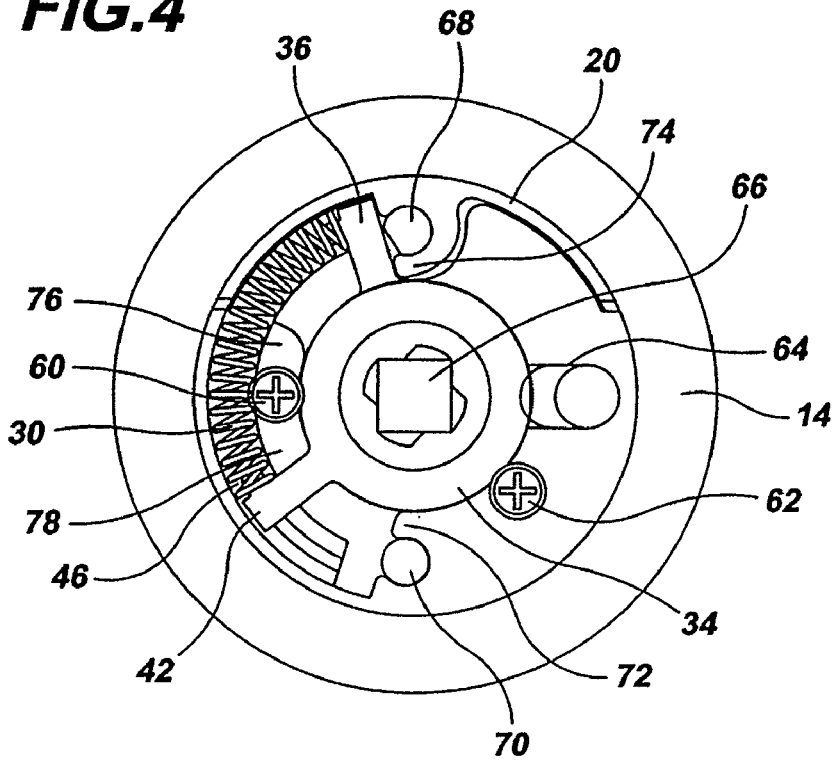
FIG. 4 is a front elevational view of a return spring assembly corresponding to the view in FIG. 3 except that the return spring assembly is shown as it would appear with the handle rotated counterclockwise.
Figure 5:
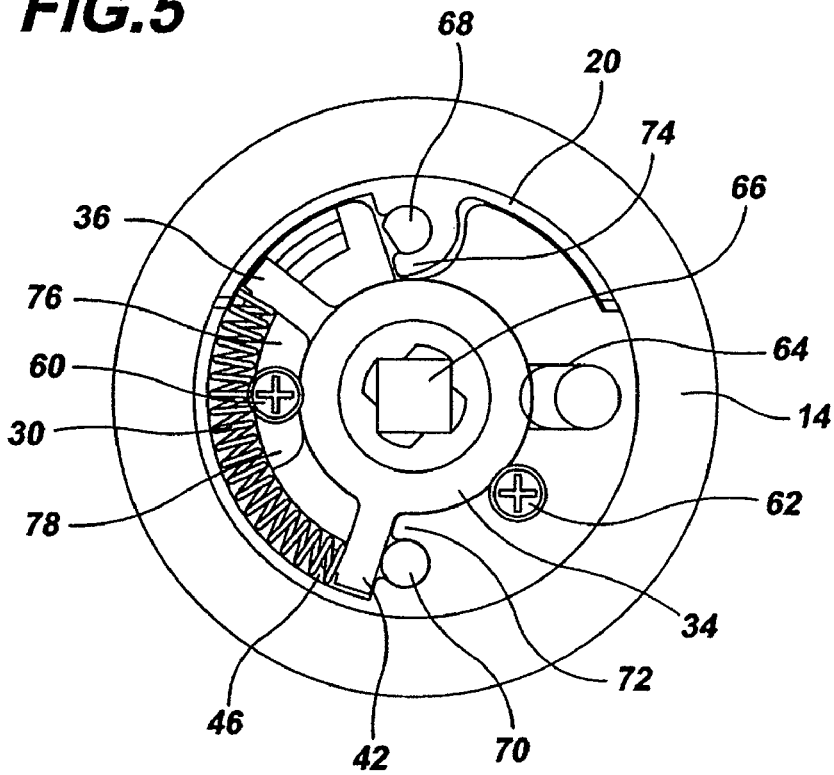
FIG. 5 is a front elevational view of a return spring assembly corresponding to the view in FIG. 3 except that the return spring assembly is shown as it would appear with the handle rotated clockwise.

The operation of the spring drivers and the lost motion interaction between the spindle and the spring drivers 32, 34 can be understood by a comparison of FIGS. 3-5. The lost motion operation of the spring drivers derives from the shape of the central openings 52, 54 in the spring drivers.

The shape of the central openings is defined by a partial rotation of the cross sectional shape of the spindle. In the preferred design, the spindle 66 is conventional and its cross-sectional shape is a square. The square cross-sectional shape is partially rotated by approximately the angle that the handle is to be allowed to rotate relative to the horizontal to define the shape of the central openings 52, 54. This produces the approximately cross-shaped central opening seen in the drawings.

As a result of this shape, a square shaft spindle 66 can turn inside the spring driver openings 52, 54 over a limited range without turning the spring driver. At the limits of rotation, however, the spindle engages the opening and begins to turn the spring driver. As can be seen in FIG. 3, the two spring drivers 32, 34 are identical, but they have been flipped so that the projections 38 and 44 face each other. The central openings 52, 54, despite being in the identical position on identical spring drivers, end up rotated relative to each other due to the relative rotated position of the spring drivers.

Accordingly, if spindle 66 begins to rotate clockwise from the rest position, it turns only the second spring driver 34 and compresses spring 30 from only the second end 46 without turning the first spring driver. The spring is compressed until the position seen in FIG. 4 is reached. However, if the spindle 66 rotates counterclockwise, it turns only the first spring driver 32 and compresses spring 30 from the first end 40 without turning the second spring driver 34 until the position seen in FIG. 5 is reached. When no force is applied to the handle, the compression spring 30 expands and drives both spring driver arms 36, 42 away from each other to the position seen in FIG. 3, which returns the handle to the horizontal position.

The spring housing 12 is also provided with a pair of openings 68, 70 that receive corresponding screws and studs to attach the first return spring assembly 10 to a second spring assembly 22 as seen in FIG. 6. This clamps the first and second spring assemblies together and grips the door 18 between the respective outer flanges and holds the latchbolt lock mechanism 24 securely between the respective curved sections 20, 26.

This design integrates the latchbolt lock mechanism 24, the return spring assemblies 10, 22 and the door 18 into a cohesive unit that is highly resistant to a brute force attack. It is particularly designed to resist the excess force that can be applied through lever handles. In furtherance of this design goal, the spring driver arms 36, 42 contact bosses 72, 74, 76 and 78 at the base of the arms 36 and 42 when the spindle reaches the limits of rotation.

As can be seen in FIG. 4, when the handle and spindle are turned clockwise, the second spring driver can turn until its arm 42 contacts boss 78. As the second spring driver reaches the limit of rotation, the first spring driver 32 is engaged due to the shapes of the openings in the center of the spring drivers. Any attempt to continue the clockwise rotation of the spindle is resisted by the contact between the second arm 42 and the boss 78 and by the contact between the first arm 36 and the boss 74.

In a similar manner, any attempt to excessively rotate the handle and spindle in the counterclockwise direction is resisted by the combined contact between the first arm 36 and boss 76 and the second arm 42 and boss 72. It will also be seen that each spring driver arm has a rounded or filleted connection to the spring driver at the base of the arm to reduce stress at this point and prevent the arm from breaking or cracking under high loads. Each boss is provided with a corresponding rounded shape to match the filleted base of the spring driver arms. This design effectively transfers any excess force applied to the handle through the return spring assembly to the door.

In the preferred designs, the spring drivers 32, 34 are formed from a flat sheet of material and are in face to face contact, except that they are reversed so that the projections 38, 44 face each other to engage the ends of the spring 30. Identical pieces reduces the parts count and decreases manufacturing cost, as well as reducing errors in assembly.

In the preferred design, the curved section on the housing extends around the perimeter of the return spring assembly less than one hundred eighty degrees, and extends into the door more than half the thickness of the door. This ensures that the curved sections from return spring assemblies on opposite sides of the door do not interfere with each other, but extend sufficiently to engage the top and bottom of the latchbolt lock mechanism 24.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A return spring assembly adapted for installation in a bored opening in a door, the return spring assembly comprising:

a spring housing including:

an outer flange having a first surface for making fixed supporting contact with a face of the door and a second surface opposed to the first surface and facing away from the door, the outer flange having a diameter greater than a diameter of the bored opening in the door; and an inner portion having a diameter less than the diameter of the bored opening in the door, the inner portion extending from the first surface of the outer flange at least partially into the bored opening in the door and away from the second surface of the outer flange when the first surface of the outer flange is in contact with the face of the door, the inner portion including:

a curved section extending less than one hundred eighty degrees around a perimeter of the inner portion and away from the second surface of the outer flange, the curved section extending more deeply into the bored opening than the remainder of the inner portion when the first surface of the outer flange is in contact with the face of the door; and an annular spring channel, the annular spring channel, inner portion and outer flange of the spring housing being fixed relative to each other and to the door when the first surface of the outer flange is in contact with the face of the door during all operating states of the return spring assembly;

a compression spring located within the spring channel, the spring being located within the bored opening in the door when the outer flange is in supporting contact with a face of the door; and a first spring driver having an arm engaging a first end of the spring and a second spring driver having an arm engaging a second end of the spring, each spring driver including a center shaped opening to engage a spindle driven by a handle whereby the center shaped opening of each spring driver is larger than a cross section of the spindle to provide a lost motion engagement between the spring driver and the spindle, the first spring driver moving independently of the second spring driver as the handle is rotated in a first direction to compress the spring from the first end of the spring and the second spring driver moving independently of the first spring driver as the handle is rotated in an opposite direction to compress the spring from the second end of the spring.

2. The return spring assembly according to claim 1 wherein the first and second spring drivers are driven with the lost motion, the first spring driver remaining stationary as the second spring driver moves to compress the spring from the second end and the second spring driver remaining stationary as the first spring driver moves to compress the spring from the first end.

3. The return spring assembly according to claim 1 wherein the center shaped opening of each spring driver is defined by a partial rotation of the cross-sectional shape of a spindle, the opening providing the lost motion engagement between the spring driver and the spindle.

4. The return spring assembly according to claim 1 wherein the center of each spring driver includes a cross-shaped opening defined by a partial rotation of a square cross-section of a spindle, the cross-shaped opening providing the lost motion engagement between the spring driver and the spindle.

5. The return spring assembly according to claim 1 wherein the curved section of the spring housing extends into the bored opening in the door to provide supporting contact for a lock mechanism.

6. The return spring assembly according to claim 5 wherein the curved section of the spring housing extends into the bored opening in the door into supporting contact with an upper side of the lock mechanism.

7. The return spring assembly according to claim 1 in combination with a second return spring assembly and a lock mechanism, the second return spring assembly having a second spring housing and a second curved section, the two curved sections being shaped to extend without interfering with each other into a bored opening from opposite sides of a door and into cooperating and supporting contact with the lock mechanism on opposite, upper and lower, surfaces of the lock mechanism.

8. The return spring assembly according to claim 1 wherein the first and second spring drivers are substantially identical.

9. The return spring assembly according to claim 1 wherein the first and second spring drivers are substantially flat and the first spring driver is in face to face contact with the second spring driver, and the second spring driver is installed in the return spring assembly in a reversed direction relative to the first spring driver.

10. The return spring assembly according to claim 1 wherein:

the spring housing includes four bosses;

the arm of the first spring driver contacts a first one of the bosses when the first spring driver is not being driven;

the arm of the second spring driver contacts a second one of the bosses when the second spring driver is not being driven;

the arm of the first spring driver contacts a third one of the bosses when the first spring driver is driven to maximally compress the spring; and the arm of the second spring driver contacts a fourth one of the bosses when the second spring driver is driven to maximally compress the spring in the opposite direction from the first spring driver.

11. The return spring assembly according to claim 10 wherein the arm of the first spring driver contacts the first one of the bosses when the second spring driver is driven to maximally compress the spring and the arm of the second spring driver contacts the second one of the bosses when the first spring driver is driven to maximally compress the spring from the opposite direction.

12. The return spring assembly according to claim 1 wherein the first and second spring driver arms have corresponding projections engaging opposite ends of the spring.

13. The return spring assembly according to claim 1 wherein the door has a thickness and the curved section extends into the bored opening less than the thickness of the door, but more than half the thickness of the door.

14. The return spring assembly according to claim 1 further including a hub extending through the spring housing.

15. The return spring assembly according to claim 1 further including a scalp lock adapted to attach a scalp to an outer surface of the return spring assembly.

16. The return spring assembly according to claim 1 further including a cover plate attached to the spring housing for holding the spring drivers in the spring housing.

17. The return spring assembly according to claim 1 wherein the spring housing includes an opening for receiving a lock linkage extending outward from a lock mechanism, the opening for receiving a lock linkage being located opposite the spring and spring channel.

18. The return spring assembly according to claim 1 further including a hub extending through the spring housing, the hub having a central opening shaped to engage the spindle.

19. A return spring assembly adapted for installation in a bored opening in a door, the return spring assembly comprising:

a spring housing including:

an outer flange for making supporting contact with a face of the door, the outer flange having a diameter greater than a diameter of the bored opening in the door; and an inner portion having a diameter less than the diameter of the bored opening in the door, the inner portion extending at least partially into the bored opening in the door when the outer flange is in contact with the face of the door, the inner portion including:

a curved section extending partially around a perimeter of the inner portion and at least a half door thickness depth into the bored opening; and an annular spring channel;

a compression spring located within the spring channel; and a first spring driver having an arm engaging a first end of the spring, and a second spring driver having an arm engaging a second end of the spring, each spring driver including a cross-shaped center opening shaped to engage a square cross-section spindle driven by a handle whereby the center cross-shaped opening of each spring driver is larger than the square cross-section of the spindle to generate a gap that provides a lost motion engagement between the spring driver and the spindle, and each spring driver arm having a projection for engaging the spring, the first spring driver moving independently of the second spring driver as the handle is rotated in a first direction to compress the spring from the first end of the spring and the second spring driver moving independently of the first spring driver as the handle is rotated in an opposite direction to compress the spring from the second end of the spring.

20. A return spring assembly adapted for installation in a bored opening in a door, the return spring assembly comprising:

a spring housing including:

an outer flange having a diameter greater than a diameter of the bored opening in the door;

an inner portion having a diameter less than the diameter of the bored opening in the door, the inner portion extending at least partially into the bored opening in the door when the outer flange is in contact with the face of the door, the inner portion including:

a curved section extending partially around a perimeter of the inner portion and at least a half door thickness depth into the bored opening; and an annular spring channel, the annular spring channel, inner portion and outer flange of the spring housing being fixed relative to each other and to the door when the first surface of the outer flange is in contact with the face of the door during operation of the return spring assembly; and at least two curved bosses located radially inwards of the annular spring channel;

a compression spring located within the spring channel;

a first, substantially flat, spring driver having an arm engaging a first end of the spring and a second, substantially identical, spring driver having an arm engaging a second end of the spring, each spring driver including a cross-shaped center opening shaped to engage, with a lost motion engagement, a square cross-section spindle driven by a handle, each spring driver arm being connected to its associated spring driver with a filleted base having a curvature corresponding to the curved bosses and each arm having a projection for engaging the spring, the first spring driver moving independently of the second spring driver as the handle is rotated in a first direction to compress the spring from the first end of the spring and the second spring driver moving independently of the first spring driver as the handle is rotated in an opposite direction to compress the spring from the second end of the spring;

a cover plate attached to the spring housing to hold the spring in the spring channel; and a hub extending through the spring housing, the hub having a central opening shaped to engage the spindle.

* * * * *